US006498442B2

(12) United States Patent
Hara et al.

(10) Patent No.: US 6,498,442 B2
(45) Date of Patent: Dec. 24, 2002

(54) SELF-HEATING TYPE COLD-CATHODE DISCHARGE TUBE CONTROL APPARATUS

(75) Inventors: Yoshimasa Hara, Nagoya (JP); Masami Kataoka, Anjo (JP); Nobuhiko Wakayama, Nagoya (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 09/941,688

(22) Filed: Aug. 30, 2001

(65) Prior Publication Data

US 2002/0053886 A1 May 9, 2002

(30) Foreign Application Priority Data

Nov. 6, 2000 (JP) ..... 2000-337833

(51) Int. Cl.[7] ..... G05F 1/00

(52) U.S. Cl. ..... 315/309; 315/362; 315/307; 315/158; 315/117

(58) Field of Search ..... 315/149, 151, 315/158, 112, 115, 116, 117, 94, 97, 105, 291, 307, 309, 362, 77

(56) References Cited

U.S. PATENT DOCUMENTS 4,645,974 A * 2/1987 Asai ..... 313/15
5,907,222 A * 5/1999 Lengyel et al. ..... 313/493
6,061,528 A * 5/2000 Ichihara et al. ..... 396/205
6,191,568 B1 * 2/2001 Poletti ..... 315/360

* cited by examiner

*Primary Examiner*—Haissa Philogene
(74) *Attorney, Agent, or Firm*—Nixon & Vanderhye P.C.

(57) ABSTRACT

In a control apparatus for a self-heating type cold-cathode discharge tube, a microcomputer determines boosting time based on a detected surrounding temperature of the cold-cathode discharge tube. The boosting time is increases as the detected temperature decreases. A switching circuit, powered from a direct current power supply, performs a switching operation based on a determination output from the microcomputer. An inverter circuit actuates the cold-cathode discharge tube based on the switching operation which is duty-controlled. The duty ratio is determined to be higher when the detected surrounding temperature is within a predetermined low temperature range than outside the predetermined low temperature range.

7 Claims, 3 Drawing Sheets

FIG. 1
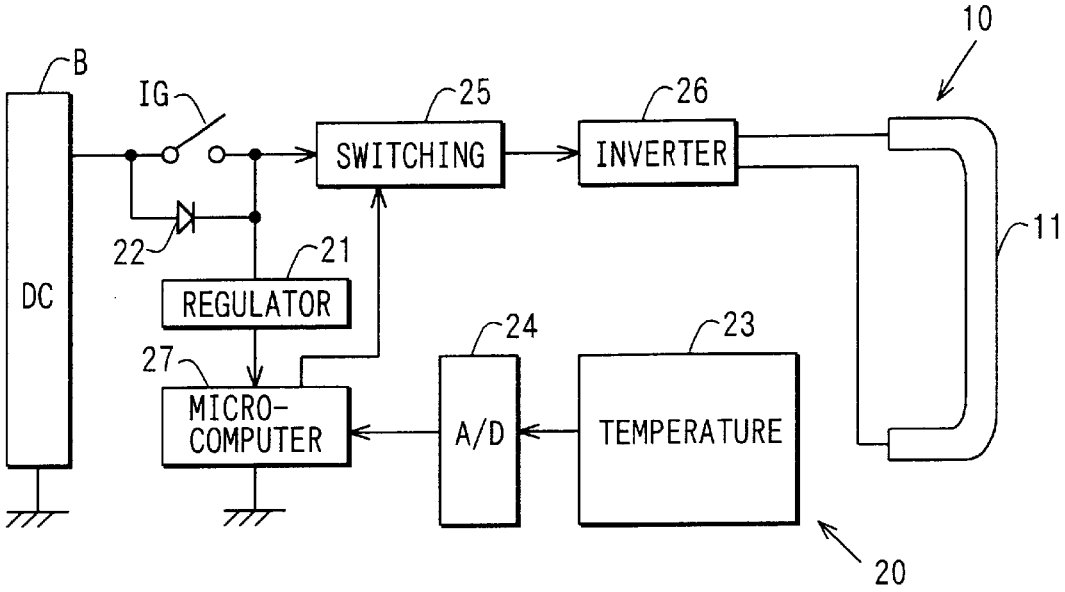
FIG. 3
| TEMPERATURE (°C) | BOOSTING TIME (SEC) |
|---|---|
| -30 | 60 |
| -20 | 50 |
| -10 | 40 |
| 0 | 30 |
| +10 | 20 |
| +20 | 10 |
FIG. 4
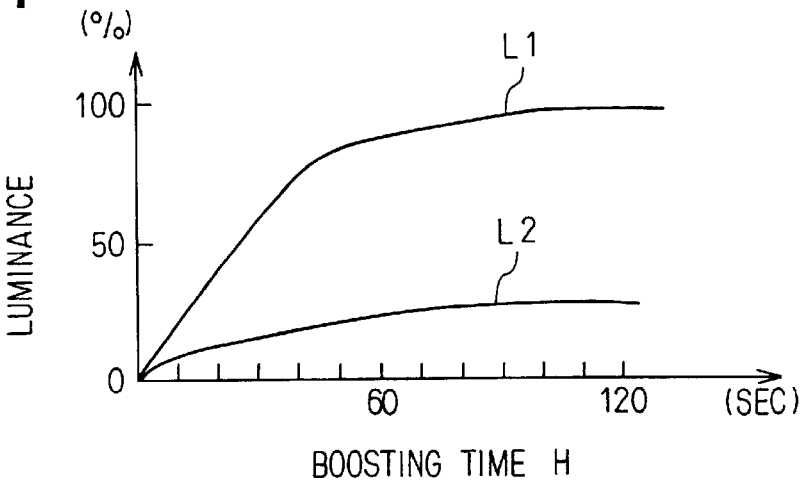

SELF-HEATING TYPE COLD-CATHODE DISCHARGE TUBE CONTROL APPARATUS

CROSS REFERENCE TO RELATED APPLICATION

This application is based on and incorporates herein by reference Japanese Patent Application No. 2000-337833 filed on Nov. 6, 2000.

BACKGROUND OF THE INVENTION

The present invention relates to a self-heating type cold-cathode discharge tube control apparatus.

A general-type cold-cathode discharge tube has, as shown in FIG. 6, an elongated tube body 1, electrodes 2 provided on both ends in the tube body 1 in its lengthwise direction, and noble gas (inert gas) 3 and mercury 4 filled in the tube body 1. This general-type cold-cathode discharge tube is actuated by application of alternating current voltage between both electrodes 2 independently of heated energy, in principle. However, the pressure of the noble gas 3 in the tube body 1 is low. Accordingly, when the cold-cathode discharge tube is actuated, if the surrounding temperature of the cold-cathode discharge tube is low, there are few opportunities of collision between electrons emitted between the electrodes 2 and gas particles 3*a* in the noble gas 3, and heat generation by the collision cannot be expected. As a result, the temperature of the cold-cathode discharge tube does not easily increase. The evaporation of the mercury 4 cannot be expected, and the amount of ultraviolet rays generated by collision between vapors 4*a* of the mercury 4 and the electrons is small. As a result, there are few opportunities of collision between a light emission layer of the inner surface of the tube body 1 and the ultraviolet rays, and the light emission luminance of the general-type cold-cathode discharge tube is low at a low temperature.

To compensate for the shortage of light emission luminance upon actuation of a general-type cold-cathode discharge tube at a low temperature, a heater is provided in the vicinity of the general-type cold-cathode discharge tube. The heater is driven by a heater drive circuit so as to increase the temperature of the tube body by heat generation by the heater, to promote evaporation of the mercury 4, to increase collision between the vapors 4*a* of the mercury 4 and the electrons e, to increase the light emission luminance.

In the general-type cold-cathode discharge tube, even in the case where the shortage of light emission luminance upon actuation of the cold-cathode discharge tube at a low temperature is compensated by raising the temperature of the tube body by the heater, the heater and the heater drive circuit are used as necessary component parts. That is, a control apparatus to control the general-type cold-cathode discharge tube must be provided with the heater and the heater drive circuit. As a result, the construction of the control apparatus is complicated, and further, the cost is increased.

On the other hand, the general-type cold-cathode discharge tube may be replaced by a self-heating type cold-cathode discharge tube which does not require a heater and a heater drive circuit.

The self-heating type cold-cathode discharge tube has the same construction as that of the general-type cold-cathode discharge tube except that the pressure of the noble gas in the tube body is higher than that in the general-type cold-cathode discharge tube as shown in FIG. 7. In FIG. 7, reference symbol A denotes an area of pressure and partial pressure of the noble gas in the general-type cold-cathode discharge tube, and the reference symbol C denotes an area of pressure and partial pressure of the noble gas in the self-heating type cold-cathode discharge tube.

Accordingly, if the surrounding temperature of the tube body of the self-heating type cold-cathode discharge tube is low, the mercury does not easily vaporize. However, as the pressure of the noble gas is high when the alternating current voltage is applied between the electrodes, the gas particles of the noble gas and the electrons more easily collide with each other than in the general-type cold-cathode discharge tube. Thus the temperature rises due to the heat generation by the collision. Accordingly, the mercury can more easily vaporize than in the general-type cold-cathode discharge tube.

Therefore, it is proposed to improve the shortage of light emission luminance at a low temperature by raising the temperature of the tube body by boosting the flow of electrons as a current, emitted between the electrodes.

However, if the same current boosting is performed at a high temperature in the self-temperature-rise type cold-cathode discharge tube, as the pressure of the noble gas is high, the temperature of the tube body tends to rise excessively, and the life of the cold-cathode discharge tube is shortened.

To address this inconvenience, it is necessary to always monitor the temperature of the tube body of the cold-cathode discharge tube and to control in real time the current which flows through the tube body in correspondence with the temperature of the tube body so as to limit the temperature from rising excessively. As a result, however, the control of the self-heating type cold-cathode discharge tube becomes complicated.

SUMMARY OF THE INVENTION

The present invention has been made to solve the above problems and has its object to provide a control apparatus which improves a luminance rise of a self-heating type cold-cathode discharge tube at a low temperature with a simple control without controlling excessive temperature rise of the discharge tube.

In accordance with the present invention, a control apparatus uses characteristic data, previously determined such that boosting time to boost a current which flows through a cold-cathode discharge tube upon actuation of the tube becomes shorter with a rise of detected temperature of the cold-cathode discharge tube and becomes longer with a fall of the detected temperature.

When the detected temperature is in a predetermined low temperature range as a cause of shortage of luminance, the control apparatus determines the boosting time in correspondence with the detected temperature. During the boosting time, the control apparatus controls the cold-cathode discharge tube with an alternating current voltage determined to properly maintain the light emission luminance of the discharge tube. In this arrangement, even if the temperature of the cold-cathode discharge tube is low, the cold-cathode discharge tube performs excellent light emission without shortage of luminance. Further, as this advantage can be attained by utilizing the boosting time determined based on the characteristic data, the control process does not become complicated.

BRIEF DESCRIPTION OF THE DRAWINGS

The above and other objects, features and advantages of the present invention will become more apparent from the following detailed description made with reference to the accompanying drawings. In the drawings:

FIG. 1 is a block diagram showing a self-heating type cold-cathode discharge tube control apparatus according to an embodiment of the present invention;

FIG. 3 is a data map showing the relation between detected temperature and current boosting time in the embodiment;

FIG. 4 is a graph showing the relation between time of a simplified self-heating type cold-cathode discharge tube and light emission luminance in a comparison between the case where current boost is used and the case where the current boost is not used;

DETAILED DESCRIPTION OF THE PREFERRED EMBODIMENT

A preferred embodiment of the present invention will now be described with reference to the accompanying drawings.

Referring to FIG. 1, a control apparatus 20 is applied to control a simplified self-heating type cold-cathode discharge tube 10 employed for a display lighting system in a vehicle.

Figure 7:
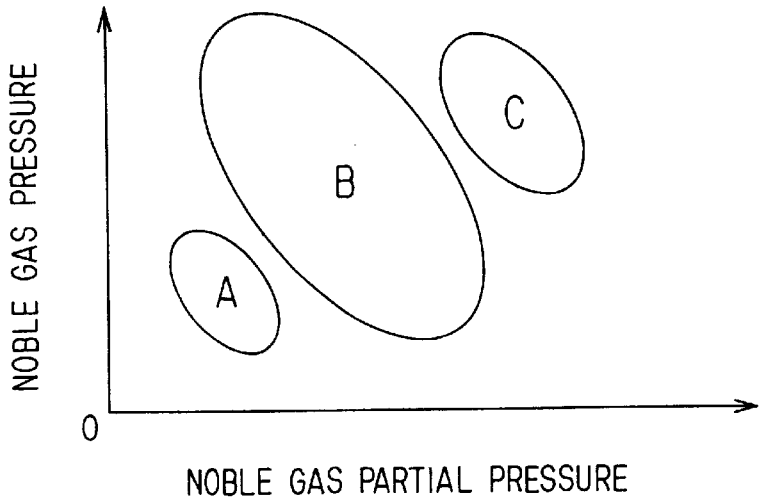
FIG. 7 RELATED ART
FIG. 7 is a graph showing distribution of the relations between partial pressure and pressure of noble gas in the general-type cold-cathode discharge tube, the self-heating type cold-cathode discharge tube, and the simplified self-heating type cold-cathode discharge tube.

The self-heating type cold-cathode discharge tube 10 is provided in the rear of an instrument panel (not shown) of the vehicle. The cold-cathode discharge tube 10 has an elongated tube body 11, electrodes provided on both ends in the tube body 11 in its lengthwise direction, and a noble gas (inert gas) such as xenon gas or neon gas and mercury filled in the tube body 11. The inner surface of the tube body 11 is uniformly coated with fluorescent material as a light emission layer. Further, the pressure of the noble gas in the cold-cathode discharge tube 10 is at an intermediate level between that of noble gas in a self-heating type cold-cathode discharge tube and that of noble gas in a general type cold-cathode discharge tube. More specifically, areas of the pressure and partial pressure of the noble gas in the cold-cathode discharge tube 10 are denoted by reference symbol B in FIG. 7.

In the cold-cathode discharge tube 10, flow of electrons emitted between the electrodes in accordance with a surrounding temperature of the tube body 11 passes through the noble gas in the tube body 11 as a current. Then, the electrons as the current collide against gas particles of the noble gas in the tube body 11, causing heat, to promote evaporation of the mercury and temperature rise in the tube body 11. The tube body 11 emits light by increased collision between the light emitting layer and ultraviolet rays. This causes the cold-cathode discharge tube 10 to emit light with luminance corresponding to the light emission of the light emission layer.

The control apparatus 20 has a voltage regulator circuit 21 which is connected to a positive-side terminal of a direct current power supply B as a battery (12V) of the vehicle via an ignition switch IG of the vehicle, and connected to the positive-side terminal of the battery B via a reverse current preventing diode 22. The voltage regulator circuit 21, powered from the backward current preventing diode 22, always regulates the battery voltage to the constant voltage (e.g., 5V).

Further, the control apparatus 20 has a temperature sensor 23, an A/D converter 24, a switching circuit 25, an inverter circuit 26 and a microcomputer 27. The temperature sensor 23, provided in the vicinity of the tube body 11 of the cold-cathode discharge tube 10, detects a surrounding temperature of the tube body 11. The A/D converter 24 converts the surrounding temperature detected by the temperature sensor 23 into a digital value and outputs it as a detected temperature of the tube body 11 to the microcomputer 27.

The switching circuit 25 performs a switching operation under the duty control of the microcomputer 27 during current boosting time. The inverter circuit 26, powered from the direct current power supply B via the ignition switch IG, receives a duty voltage in correspondence with the switching operation of the switching circuit 25, converts the voltage into a duty-controlled alternating current voltage, and applies the voltage across the electrodes of the tube body 11.

Figure 2:
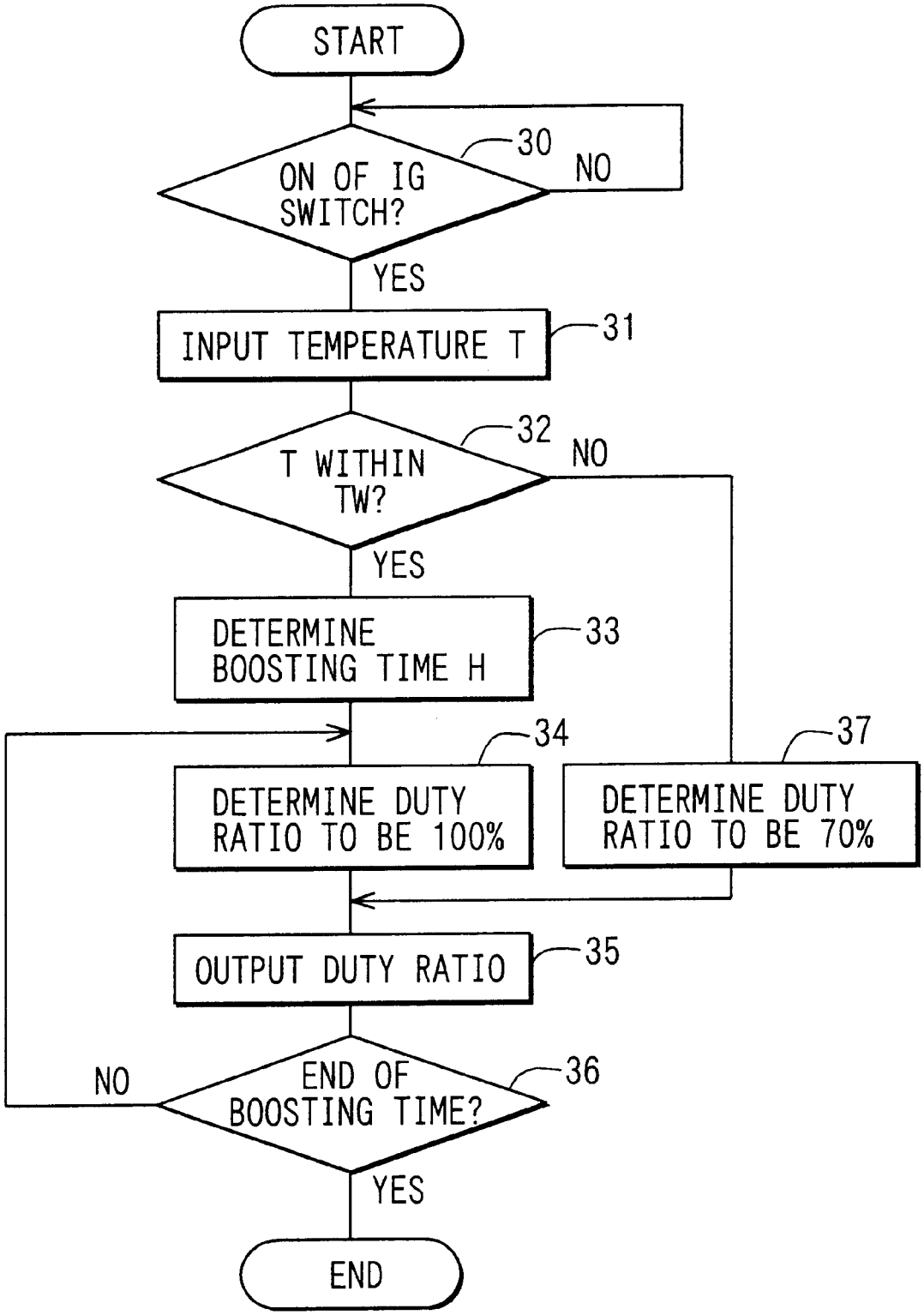
FIG. 2 is a flowchart showing an operation of a microcomputer used in the embodiment.

The microcomputer 27 executes a computer program in accordance with the flowchart of FIG. 2. During the execution of the program, the microcomputer 27 performs calculation processing to duty-control the switching operation of the switching circuit 25 in correspondence with the detected temperature from the A/D converter 24. The microcomputer 27 is ready to start upon reception of constant voltage from the voltage regulator circuit 21. Further, the computer program is previously stored-in a ROM of the microcomputer 27.

In the present embodiment, the voltage regulator circuit 21, always powered from the direct current power supply B through the diode 22, generates the constant voltage. The microcomputer 27, supplied with the constant voltage from the voltage regulator circuit 21 regardless of the operation of the ignition switch IG, is always ready to start. Accordingly, the microcomputer 27 always executes the computer program. When the ignition switch IG is OFF, the microcomputer 27 repeats determination as NO at step 30 in the flowchart of FIG. 2.

In this state, when the ignition switch IG is turned on, the determination at step 30 becomes YES. At step 31, the A/D converter 24 converts the surrounding temperature detected by the temperature sensor 23 into a corresponding digital value and inputs the temperature as a detected temperature T into the microcomputer 27.

Then, at step 32, it is determined whether or not the detected temperature T is within a predetermined temperature range TW. In the present embodiment, the temperature range TW is a low temperature range from −30° C. to +20° C., in consideration of sudden temperature changes inside the instrument panel due to changes of running areas of the vehicle and seasons and a low temperature area as a cause of the luminance shortage of the cold-cathode discharge tube 10. This data is previously stored in the ROM of the microcomputer 27.

If the detected temperature T is within the temperature range TW, the determination at step 32 is YES. At step 33, boosting time H is determined based on the data map shown in FIG. 3, in correspondence with the detected temperature T. In the present embodiment, the map is specified by the relation between the boosting time H and the detected temperature T as shown in FIG. 3 such that the light emission luminance of the tube body 11 becomes proper in correspondence with the surrounding temperature. The map data is previously stored as data in the ROM of the microcomputer 27. When the detected temperature T is between both adjacent detected temperatures in FIG. 3, interpolation is performed in correspondence with the detected temperature T by using the difference between both adjacent boosting times corresponding to these adjacent detected temperatures, and a value obtained by the interpolation is used as the boosting time.

After the boosting time H is determined, then at step 34, the duty ratio is determined at 100% so as to continuously drive the cold-cathode discharge tube 10. After the determination, at step 35, the duty output of the 100% duty ratio is outputted to the switching circuit 25 during the determined boosting time H. The switching circuit 25 is continuously held turned on based on the duty output of the 100% duty ratio, during the boosting time H.

The inverter circuit 26, powered by the direct current voltage from the direct current power supply B via the ignition switch IG, is supplied with the duty voltage of the 100% duty ratio from the switching circuit 25 during the determined boosting time H, inverse-converts the voltage into a duty-controlled alternating current voltage and applies it between the electrodes of the cold-cathode discharge tube 10. The application of alternating current voltage is repeated until the determination at step 36 becomes YES.

As understood from FIG. 3, the determined boosting time H becomes longer as the detected temperature T is lower, the duty-controlled alternating current voltage of the 100% duty ratio is applied between the electrodes of the cold-cathode discharge tube 10 during the boosting time H which is longer as the detected temperature T is lower. Accordingly, during the boosting time H which is longer as the detected temperature T is lower, a large amount of electrons are emitted between the electrodes of the cold-cathode discharge tube 10 so as to satisfy the 100% duty ratio.

By this arrangement, heat generation by collision between the electrons and the gas particles of the noble gas in the tube body 11 is properly ensured in correspondence with the surrounding temperature of the tube body 11. The mercury is properly vaporized, and by the collision between the mercury and the electrons, the ultraviolet rays can be properly ensured in accordance with the surrounding temperature. Thus, the collision between the ultraviolet rays and the light emission layer of the tube body 11 can be properly ensured in correspondence with the surrounding temperature of the tube body 11, and the light emission luminance of the cold-cathode discharge tube 10 can be properly ensured.

Regarding the changes of light emission luminance of the cold-cathode discharge tube 10 in accordance with elapse of time, a comparison is made between the case where current boost is used and the case where the current boost is not used, and data as shown in FIG. 4 is obtained. In the graph of FIG. 4, a line L1 represents light emission luminance in the case where the current boost is employed as in the case of the present embodiment, while a line L2, light emission luminance in the case where the current boosting is not employed. According to L1 the result of comparison, it is understood that in the line L1, the light emission luminance immediately after the actuation of cold-cathode discharge tube 10 at a low temperature is more greatly improved than in the line L2.

After the processing at step 35, when the determined boosting time H has elapsed, the determination at step 36 becomes YES, the processing ends. On the other hand, when the determination at step 32 becomes NO, the process proceeds to step 37, at which the duty ratio is determined to be 70%, and applied as the duty output to the switching circuit 25. The switching circuit 25 performs a switching operation of the 70% duty ratio under the control of the microcomputer 27.

In accordance with the switching operation, the inverter circuit 26, powered by the direct current voltage from the direct current power supply B via the ignition switch IG, is supplied with the duty voltage of the 70% duty ratio from the switching circuit 25 during the determined boosting time H, inverse-converts the voltage into a duty-controlled alternating current voltage and applies it across the electrodes of the cold-cathode discharge tube 10. Then a large amount of electrons are emitted between the electrodes of the cold-cathode discharge tube 10 so as to satisfy the 70% duty ratio.

By this arrangement, heat generation by collision between the electrons and the gas particles-of the noble gas in the tube body 11 is properly ensured when the detected temperature T is outside the temperature range TW. Thus, the collision between the electrons and the light emission layer of the tube body 11 can be properly ensured, and the light emission luminance of the cold-cathode discharge tube 10 can be properly ensured. In this case, as the duty ratio of the duty-controlled alternating current voltage is reduced to 70%, the temperature of the cold-cathode discharge tube 10 is not excessively increased. As a result, the life of the cold-cathode discharge tube 10 can be prolonged. The life of the cold-cathode discharge tube is not influenced by this rough control since the gas pressure of the simplified cold-cathode discharge tube is lower than that of the self-heating type cold-cathode discharge tube and the temperature of the tube body of the cold-cathode discharge tube does not extremely increase even though the current boosting time is longer to some extent.

Figure 5:
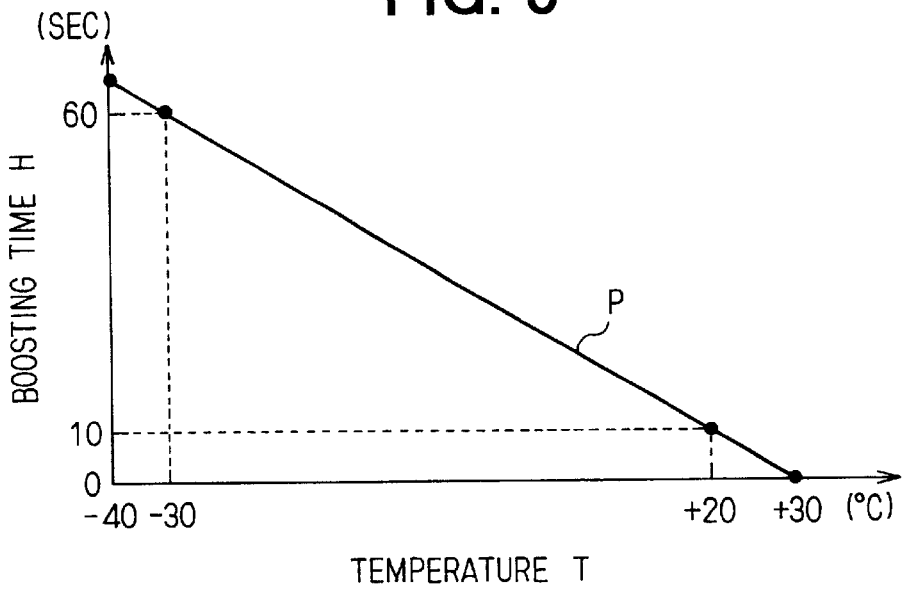
FIG. 5 is a graph showing the relation between detected temperature and current boosting time as a modification to the embodiment.
Figure 6:
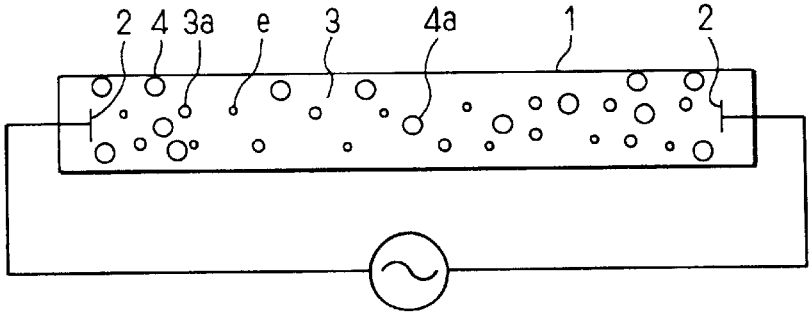
FIG. 6 RELATED ART
FIG. 6 is a schematic diagram showing a general-type cold-cathode discharge tube according to a related art of the present invention.

FIG. 5 shows a modification of the above embodiment. In the modification, the map in FIG. 3 is replaced with a graph as shown in FIG. 5 showing a characteristic straight line P specifying the relation between the boosting time H and the detected temperature T. The characteristic straight line P is set such that the boosting time H becomes shorter (or longer) in accordance with a rise (or fall) of the detected temperature T, and the line P is previously stored as linear data, in place of the map in FIG. 3, in the ROM of the microcomputer 27. The characteristic straight line P is specified by a linear expression $H=-T+30$ within the range of $-40°\ C. \leqq T \leqq +30°\ C.$ In this modification, as in the case of the above embodiment, when the determination at step 32 becomes YES, the process proceeds to the next step 33, at which the boosting time H is determined in correspondence with the detected temperature T based on the characteristic straight line P in FIG. 5 in place of the map in FIG. 3. As the characteristic straight line P is a linearly-changing data, the boosting time can be determined without interpolation.

In this manner, when the boosting time H is determined, the duty ratio is determined to be 100% at step 34 as in the case of the above embodiment, and at step 35, the duty output of the 100% duty ratio is applied to the switching circuit 25 during the boosting time H determined based on the characteristic straight line P.

The switching circuit 25 performs the switching operation of the 100% duty ratio during the boosting time H based on the characteristic straight line P. The operation thereafter is the same as that in the above embodiment. By this arrangement, the advantage described in the above embodiment can be attained while the control by the inverter circuit 26 on the cold-cathode discharge tube 10 is performed in a manner more elaborate than in the above embodiment.

In implementation of the present invention, the map in FIG. 3 and the characteristic straight line P in FIG. 5 may be arbitrarily changed in accordance with necessity.

Further, in implementation of the present invention, the switching circuit 25 may be included in the inverter circuit 26. Further, the inverter circuit 26 may be replaced with a high voltage circuit which generates a high alternating current voltage so as to drive the cold-cathode discharge tube 10 by the high voltage circuit.

Further, in implementation of the present invention, the characteristic straight line P in FIG. 5 may be replaced with data to reduce (or increase) the boosting time H in correspondence with a rise (or fall) of the detected temperature T, and the boosting time may be determined at step 33.

Further, in implementation of the present invention, the determination of the duty ratio at step 34 is not limited to 100% but may be set to any duty ratio to properly ensure the light emission luminance of the cold-cathode discharge tube 10 at a low temperature. Further, the determination of the duty ratio at step 37 is not limited to 70% but may be set to any duty ratio not to overheat the cold-cathode discharge tube 10 by the current boost.

Further, the present invention may be applied to a simplified self-heating type cold-cathode discharge tube and a self-heating type cold-cathode discharge tube generally incorporated in a vehicle, and other simplified self-heating type cold-cathode discharge tube of illumination system employed and a self-heating type cold-cathode discharge tube used in general buildings, as well as in a vehicle illumination system. In use for an electric vehicle illumination system, a key switch to start an electric motor as a prime motor of the electric vehicle corresponds to the ignition switch IG. Further, in use for an illumination system used in a general building, an arbitrary operation switch is employed in place of the ignition switch IG.

What is claimed is:

1. A self-heating type cold-cathode discharge tube control apparatus comprising:

temperature detection means for detecting a surrounding temperature of a self-heating type cold-cathode discharge tube actuated upon application of an alternating current voltage;

boosting time determination means for determining boosting time to boost a current, that flows through the cold-cathode discharge tube in accordance with actuation of the tube, in correspondence with the temperature detected by the temperature detection means upon actuation of the cold-cathode discharge tube, based on characteristic data previously determined such that the boosting time becomes shorter with a rise of the temperature and becomes longer with a fall of the temperature;

temperature range determination means for determining whether the temperature is within a predetermined low temperature range that is a cause of luminance shortage of the cold-cathode discharge tube;

voltage determination means for determining the alternating current voltage so as to properly maintain light emission luminance of the cold-cathode discharge tube in accordance with a determination by the temperature range determination means that the temperature is within the low temperature range; and control means for controlling the actuation of the cold-cathode discharge tube based on the alternating current voltage determined by the voltage determination means during the boosting time determined by the boosting time determination means.

2. The self-heating type cold-cathode discharge tube control apparatus according to claim 1 further comprising:

switch means operable for actuation of the cold-cathode discharge tube, wherein the temperature detection means detects the surrounding temperature upon operation of the switch means.

3. The self-heating type cold-cathode discharge tube control apparatus according to claim 1, wherein:

the self-heating type cold-cathode discharge tube is a simplified self-heating type cold-cathode discharge tube;

the characteristic data is linear data previously determined such that the boosting time linearly becomes shorter with the rise of the temperature and linearly becomes longer with the fall of the temperature;

the boosting time determination means determines the boosting time in correspondence with the temperature based on the linear data;

the voltage determination means determines the alternating current voltage as an alternating current voltage of a duty ratio to properly maintain the light emission luminance of the cold-cathode discharge tube; and the control means controls the actuation of the cold-cathode discharge tube based on the alternating current voltage of the duty ratio determined by the voltage determination means.

4. The self-heating type cold-cathode discharge tube control apparatus according to claim 1, wherein:

the characteristic data is map data previously determined such that the boosting time becomes shorter with the rise of the temperature and becomes longer with the fall of the temperature;

the boosting time determination means determines the boosting time in correspondence with the temperature based on the map data;

the voltage determination means determines the alternating current voltage as an alternating current voltage of duty ratio to properly maintain the light emission luminance of the cold-cathode discharge tube; and the control means controls the actuation of the cold-cathode discharge tube based on the alternating current voltage of the duty ratio determined by the voltage determination means.

5. The self-heating type cold-cathode discharge tube control apparatus according to claim 2, wherein:

the self-heating type cold-cathode discharge tube is a simplified self-heating type cold-cathode discharge tube incorporated in a vehicle;

the switch means is a key switch operable upon actuation of a prime motor of the vehicle; and the boosting time determination means determines the boosting time in correspondence with the temperature detected by the temperature detection means upon operation of the key switch, based on the characteristic data.

6. The self-heating type cold-cathode discharge tube control apparatus according to claim 5, wherein:

the characteristic data is linear data previously determined such that the boosting time linearly becomes shorter with the rise of the temperature and linearly becomes longer with the fall of the temperature;

the boosting time determination means determines the boosting time in correspondence with the temperature based on the linear data;

the voltage determination means determines the alternating current voltage as an alternating current voltage of a duty ratio to properly maintain the light emission luminance of the cold-cathode discharge tube; and the control means controls the actuation of the cold-cathode discharge tube based on the alternating current voltage of the duty ratio determined by the voltage determination means.

7. The self-heating type cold-cathode discharge tube control apparatus according to claim 5, wherein:

the characteristic data is map data previously determined such that the boosting time becomes shorter with the rise of the temperature and becomes longer with the fall of the temperature;

the boosting time determination means determines the boosting time in correspondence with the temperature based on the map data;

the voltage determination means determines the alternating current voltage as an alternating current voltage of a duty ratio to properly maintain the light emission luminance of the cold-cathode discharge tube; and the control means controls the actuation of the cold-cathode discharge tube based on the alternating current voltage of the duty ratio determined by the voltage determination means.

* * * * *